US006617297B2

(12) United States Patent
Mente et al.

(10) Patent No.: US 6,617,297 B2
(45) Date of Patent: Sep. 9, 2003

(54) AUTOMATIC DISHWASHING TABLETS WITH IMPROVED CHLORINE STABILITY

(75) Inventors: Glenis R. Mente, Grosse Ile, MI (US); Kenneth L. Zack, Wyandotte, MI (US); Michael C. Welch, Woodhaven, MI (US)

(73) Assignee: BASF Corporation, Mt. Olive, NJ (US)

( * ) Notice: Subject to any disclaimer, the term of this patent is extended or adjusted under 35 U.S.C. 154(b) by 0 days.

(21) Appl. No.: 09/820,288

(22) Filed: Mar. 29, 2001

(65) Prior Publication Data

US 2002/0187907 A1 Dec. 12, 2002

(51) Int. Cl.[7] ..... C11D 17/00; C11D 1/722; C11D 3/395

(52) U.S. Cl. ..... 510/224; 510/226; 510/379; 510/381; 510/446; 510/505

(58) Field of Search ..... 510/224, 226, 510/446, 505, 379, 381; 134/25.2

(56) References Cited

U.S. PATENT DOCUMENTS 4,219,436 A * 8/1980 Gromer et al. ..... 510/224
4,606,775 A * 8/1986 Robinson et al. ..... 134/18
5,958,855 A * 9/1999 Binstock et al. ..... 510/224
6,191,088 B1 * 2/2001 Binstock et al. ..... 510/224
6,358,911 B1 * 3/2002 Metzger-Groom ..... 510/446

* cited by examiner

*Primary Examiner*—Lorna M. Douyon
(74) *Attorney, Agent, or Firm*—Nixon & Vanderhye PC

(57) ABSTRACT

Solid automatic dishwasher detergent tablets have a chlorine source to most preferably provide 0.5 to 5 percent available chlorine; and a chlorine stability enhancing effective amount of preferably between about 0.5 to about 10 percent by weight of one or more nonionic surfactants having the following structure:

$$R—(AO1)_x(AO2)_y—OR'$$

wherein:

R is a $C_6$–$C_{18}$ alkyl group,

AO1 represents propylene oxide or a mixture of propylene oxide and other alkylene oxides, AO2 represents ethylene oxide or a mixture of ethylene oxide and other alkylene oxides, R' is an alkyl, arylalkyl, or benzalkyl group with 1 to about 10 carbon atoms, x is 2–20, y is 0–20, and the sum of x plus y is 5 or greater.

The nonionic surfactant imparts improved chlorine stability to the tablet such that greater than 80 percent of the chlorine in the tablet remains active for eight weeks when the tablet is stored at 120° F.

20 Claims, No Drawings

AUTOMATIC DISHWASHING TABLETS WITH IMPROVED CHLORINE STABILITY

FIELD OF THE INVENTION

This invention relates to automatic dishwashing tablets with improved chlorine stability. More specifically, it relates to the use of certain nonionic surfactants in machine dishwashing detergent tablets containing chlorinating agents.

BACKGROUND OF THE INVENTION

Most machine dishwashing detergents contain a chlorine bleach component that provides sanitization and stain removal properties. Incorporation of nonionic surfactants in these detergent formulations is also highly desirable. The nonionic surfactants typically used are low foaming, are good defoamers of protein food soils, and provide wetting properties to reduce the appearance of spots and film on dishware, thus providing good sheeting action.

Chlorinating agents degrade conventional defoaming nonionic surfactants such as ethylene oxide/propylene oxide block copolymers and fatty alcohol oxyalkylates. As the chlorinating agent attacks the nonionic surfactant, the bleach is depleted and the surfactant is destroyed. Thus, desirable low-spotting filming and defoaming properties are lost along with the sanitizing and de-staining properties of the chlorinating agent.

Nonionic surfactants are commonly incorporated in automatic dishwashing detergent powders containing a chlorinating agent. In powdered detergents, the contact between the nonionic surfactant and the chlorine source is less intimate than in pressed tablets and stability can be maintained for the shelf life of the product.

In tablets, on the other hand, chlorine stability is significantly poorer than in powdered detergent formulations. One reason may be that the compression of the ingredients to form the tablet increases the contact between the nonionic surfactant and the chlorine source and degradation is accelerated.

Pressed automatic dishwasher detergent tablets, which have become more popular with the consumer over the past few years, present a special challenge for the formulator to produce a tablet with sufficient chlorine stability such that the sanitization and stain removing properties remain high throughout the shelf life of the product. Thus, from the time that the tablet is manufactured to the time of purchase and up until ultimate end use by the consumer, the shelf life may be six months or longer. An ideal formulation would retain most or all of its chlorine stability over that time period.

In order to predict the shelf life, it has been found convenient to determine the chlorine content in the tablet as a function of time during an accelerated aging test at elevated temperatures. As a rule of thumb, a tablet has sufficient chlorine stability if greater than 80 percent of the chlorine in the tablet remains active for eight weeks with the tablet stored at 120° F.

Automatic dishwashing tablets containing nonionic surfactants and a chlorine bleach compound are disclosed in U.S. Pat. No. 6,025,315 to Gorlin, the disclosure of which is hereby incorporated by reference. According to Gorlin et al '315, an automatic dishwashing composition in the form of a table comprises an alkali metal phosphate detergent builder salt, an alkali metal carbonate, a lubricant, a dialkali metal disilicate, a nonionic surfactant, and a wax-coated chlorine bleach compound.

Multiple layer detergent tablets are also known in the art as evidenced by U.S. Pat. No. 5,133,892 to Chun et al (the entire content of which is incorporated hereinto by reference. Multiple layer tablets are useful because incompatible materials can be incorporated into different layers, with an increase in shelf life.

SUMMARY OF THE INVENTION

According to the present invention, certain nonionic surfactants have been found to provide improved chlorine stability in machine dishwashing detergent tablet formulations (i.e., exhibit greater than 80 percent of the chlorine in the tablet remains active for eight weeks with the tablet stored at 120° F.) as compared to the alcohol alkoxylate nonionic surfactants that are typically used in such an end-use application. The use of these nonionic surfactants allow such formulations to retain their cleaning and defoaming properties for longer periods of time as compared to formulations containing conventional nonionic polyether surfactants.

According to particularly preferred embodiments, there is provided according to the present invention a solid automatic dishwasher detergent tablet comprising a chlorine source to provide 0.5 to 5 percent available chlorine; and 1 to 10 percent by weight of one or more nonionic surfactants having the following structure $$R—(AO1)_x(AO2)_y—OR'$$

wherein:

R is a $C_6$–$C_{18}$ alkyl group,

AO1 represents propylene oxide or a mixture of propylene oxide and other alkylene oxides, AO2 represents ethylene oxide or a mixture of ethylene oxide and other alkylene oxides, R' is an alkyl, arylalkyl, or benzalkyl group with 1 to about 10 carbon atoms, x is 2–20, y is 0–20, and the sum of x plus y is 5 or greater.

In another embodiment, a method for increasing the chlorine stability of the pressed automatic dishwashing detergent tablet is provided, wherein there is incorporated in the tablet a surfactant of the structure given above.

In accordance with the invention, the chlorine stability of the tablet is such that greater than 80 percent of the chlorine in the table remains active for eight weeks when the tablet is stored at 120° F.

These and other aspects and advantages will become more apparent after careful consideration is given to the following detailed description of the preferred exemplary embodiments thereof.

DETAILED DESCRIPTION OF THE INVENTION

The automatic dishwasher detergent tablets of the invention necessarily comprise a chlorine source. The chlorine source is most preferably present in an amount to provide from about 0.1 to about 5 percent available chlorine by weight, preferably from about 0.5 to 5 percent available chorine, and most preferably from about 0.5 to 3 percent available chlorine.

Conventional chlorine bleach compounds may be employed in the compositions of this invention, such as dichloroisocyanurate, dichlorodimethylhydantoin, or chlorinated trisodium phosphate. Other examples of chlorine sources include sodium hypochlorite, potassium hypochlorite, monobasic calcium hypochlorite, dibasic magnesium hypochlorite, potassium dichloroisocyanurate, sodium dichloroisocyanurate, trichlorocyanuric acid, 1,3-dichloro-5,5-dimethylhydantion, N-chlorosulfamide, Chloramine T, Dichloramine T, Chloramine B, and Dichloramine B.

Preferred chlorine sources are chlorinated isocyanurates including potassium dichloroisocyanurate, sodium dichloroisocyanurate, sodium dichloroisocyanurate dihydrate, trichlorocyanuric acid, and dichloroisocyanurate. A commercially available chlorine compound is ACL-59 from Monsanto, which is potassium dichloro-s-triazenetrione (i.e. potassium dichloroisocyanurate).

It is typical to formulate dishwasher tablets to a desired chlorine level. Thus, preferred formulations of the invention contain from about 0.5 to about 5 percent available chlorine. Thus, the actual amount of the chlorine compound(s) noted above should be present in the tablet at a level somewhat greater than the desired available chlorine level to ensure that the desired level of chlorine is provided. For example, the use of 3.3 percent ACL-59 provides about 2 percent available chlorine in a pressed dishwasher detergent tablet formulation of the present invention.

Chlorine stable surfactants are incorporated into the dishwasher detergent tablet compositions of the present invention. Chlorine stable surfactants of the invention are represented by the formula $$R—(AO1)_x(AO2)_y—OR'.$$

In the formula, R is a $C_6$ to $C_{18}$ alkyl group. For example, R can represent the residue of a fatty alcohol having 6 to 18 carbon atoms. Examples of such fatty alcohols include decyl alcohol, lauryl alcohol, and stearyl alcohol, as well as the commercially available blends of alcohols, such as $C_{12}$ to $C_{15}$ alcohols, or $C_{10}$ to $C_{13}$ alcohols. In a preferred embodiment, R will be in the range of approximately $C_{12}$ to $C_{15}$.

Also in the formula, AO1 represents an alkylene oxide or mixture of alkylene oxides which are polymerized onto the fatty alcohol to form a first block. The composition of AO1 will vary, but it is preferred that AO1 comprise propylene oxide. Thus, AO1 can be all propylene oxide, or it can comprise a heteric blend of propylene oxide and ethylene oxide. When AO1 is a heteric blend of propylene oxide and ethylene oxide, then $(AO1)_x$ represents a heteric block of propylene oxide and ethylene oxide. When AO1 is all propylene oxide, $(AO1)_x$ represents a propylene oxide block. By the term "heteric blend", and the like is meant a blend of two or more oxides of a given ratio. By the term heteric block, is meant the block of mixed oxides resulting from the addition of a heteric blend to a molecule.

Similarly, AO2 represents an alkylene oxide or mixture of alkylene oxides with the proviso that the relative composition of AO2 is different from AO1. Preferably, AO2 comprises ethylene oxide. When AO2 is all ethylene oxide, then $(AO2)_y$ is an ethylene oxide block. When AO2 comprises ethylene oxide and another alkylene oxide, for example, propylene oxide, then $(AO2)_y$ is a heteric block of ethylene oxide and propylene oxide.

The end group R' can be an alkyl, arylalkyl, or benzalkyl group with 1 to 10 carbon atoms. A particularly preferred R' is methyl.

The subscript x is from about 2 to about 20, while y can be from 0 to about 20.

In a preferred embodiment, y is non-zero, and x and y are both less than 10. In this embodiment, the chlorine stable surfactant of the present invention can be described as a capped fatty alcohol-initiated diblock alkoxylate, wherein the first block is based on propylene oxide or propylene oxide and another alkylene oxide; the second block is based on ethylene oxide or a mixture of ethylene oxide and another alkylene oxide; and the capping group is an alkyl, arylalkyl, or benzalkyl group containing 1 to about 10 carbon atoms, with the preferred capping group being methyl.

A preferred surfactant where y is non-zero comprises one where x and y are both less than or equal to about 10, where the first block $(AO1)_x$ is a propylene oxide block, and the second block $(AO2)_y$ is an ethylene oxide block. In a more preferred embodiment, x is less than y, so that the propylene oxide block is smaller than the ethylene oxide block. In a particularly preferred embodiment, x is less than or equal to about 5, and y is greater than x.

In another embodiment, the subscript y in the above surfactant structure is zero and the subscript x is from about 2 to about 20, so that the surfactant of the invention contains a single alkylene oxide block. In this case, the surfactant can be referred to as a capped fatty alcohol alkoxylate, where AO1 represents either propylene oxide or a heteric blend of propylene oxide and another alkylene oxide such as ethylene oxide. In this case, it is preferred that AO1 comprise a heteric blend of propylene oxide and ethylene oxide, and more preferred that the number of propylene oxide units in the heteric blend be greater than the number of ethylene oxide units. As noted above, alkoxylates having from about 2 to about 20 alkylene oxide units are preferred, as indicated by the value of the subscript x being from about 2 to about 20. The subscript x preferably has a value of less than or equal to about 10.

The automatic dishwasher detergent tablets of the invention further comprise conventional dishwashing detergent additives. Such additives include, for example:

a) 10 to 50 percent by weight of detergent builder salts, such as sodium tripolyphosphate;

b) 10 to 50 percent by weight of a dialkali metal disilicate or alkali metal silicate or mixtures thereof, examples of which include sodium metasilicate pentahydrate;

c) 5 to 50 percent by weight of an alkali metal carbonate or alkali metal citrate, such as, for example, sodium carbonate or sodium citrate; and/or d) other conventional additives such as sodium sulfate or 0.5 to 5 percent of a lubricant or optional pigments, dyes and fragrances.

The tablets of the present invention may also contain polymeric additives useful as solubilizing agents or dissolution aids.

The automatic dishwashing tablets of the current invention are prepared by incorporating the chlorine source and the chlorine stable nonionic surfactant described into a tablet using known methods. In single layer tablets, all of the ingredients are pressed together in a single layer. This can lead to stability problems if the ingredients are incompatible with one another. As noted above, the current invention solves the problem of incompatibility of the nonionic surfactant and chlorine bleach components in the situation where they are incorporated into the same layer.

Alternatively, the tablets can be multiple layer tablets. For example, the incompatible chlorine source and nonionic surfactant could be separated into different layers. The chlorine bleach component may optionally also be separated from enzymes which are deactivated by contact with bleach. Using multiple layers, the formulator can also make tablets with different acting layers, such as one layer which dissolves in cold water, and another which dissolves in warm water. The multiple layers containing different active ingredients can be fused directly to each other, or they can be separated by barrier layers.

The present invention therefore provides for tablets which contain at least one layer (i.e., the table can be either single layer or multiple layer) where a chlorine source and a nonionic surfactant are combined as an intimate homogenous mixture with one another, resulting in a tablet with good chlorine stability, especially as shown by its performance in an accelerated aging storage test at 120° F.

The capped chlorine stable surfactants of the present invention can be prepared by alkylating or endcapping a surfactant starting material having the structure $$R—(AO1)_x(AO2)_y—OH$$

where R, AO1, AO2, x, and y are as defined above. The alkylation step can be accomplished for example by reacting dimethylsulfate with the surfactant starting material. The surfactant starting material can also be treated with an alkaline material such as potassium hydroxide and further reacted with an alkyl or aryl halide in a Williamson type ether synthesis. Alternatively, the starting material can be first de-protonated with an alkyl lithium reagent, and then alkylated with an alkyl or aryl halide. The chlorine stable surfactants in Examples 1 and 2 are synthesized by reaction with butyl lithium, and subsequent reaction with methyl iodide.

The present invention will be further understood by reference to the following non-limiting examples.

EXAMPLE 1

Synthesis of a Methyl Capped Fatty Alcohol Block Alkoxylate

The starting material was a $C_{12-15}$ alcohol block alkoxylate wherein the first block was an average of 2.5 propylene oxide units and the second block was an average 4.5 ethylene oxide units, i.e. x is 2.5, and y is 4.5 in the surfactant structure above. The alkoxylate, 290.1 g was added to a 4-necked 1000 ml round bottom flask equipped with stirring shaft, nitrogen pad, thermometer, and septum, and stripped for one hour at 100° C. Then the flask was cooled, and 100 ml of tetrahydrofuran was added, along with a few milligrams of phenanthroline monohydrate and a few milligrams of 2,2-bipyridine. The contents of the flask were cooled to 5° C. in an ice bath. A solution of 1.6 M butyl lithium in hexane was added until the sample turned red. A total of 238 g of the 1.6 M butyl lithium was added. Then methyl iodide, 70.8 g was added by syringe, and the flask was allowed to come up to room temperature.

The sample was rotary evaporated at 70° C. for an hour, and then placed under high vacuum for an hour. A clear yellow syrupy liquid was recovered. Hexane was added to the liquid. This formed a yellowish liquid and a gum like layer. The yellowish liquid was separated in a separatory funnel, and was then again subjected to rotary evaporation and high vacuum stripping. Infrared analysis showed the disappearance of the hydroxyl group peak.

To increase the yield, the gum-like layer was mixed in 20 g increments with 50 g of hexane, 50 g of a 30% NaCl solution, and a small amount of sodium bisulfite. The resulting mixture was then shaken in a separatory funnel. The salt (lower) layer was removed, and the hexane layer extracted once again with 30% NaCl solution. The hexane layer is then rotary evaporated. Then a small amount of Magnesol and Celite is added, and the mixture is cold filtered (5° C.) under pressure. The total yield was 252.1 g.

EXAMPLE 2

Synthesis of a Methyl Capped Heteric Alcohol Alkoxylate

The starting material was 300.0 g of a $C_{14-15}$ heteric alcohol alkoxylate, where the heteric block consisted of 2 ethylene oxide units and 4 propylene oxide units. The methyl capped product was synthesized by the same procedure as in Example 1, except that 253 g of 1.6 M butyl lithium was used, and 72.67 g of methyl iodide were added. The total yield was 246.4 g. Infrared analysis showed the disappearance of the hydroxyl group.

EXAMPLE 3

(Comparative)—Synthesis of a Methyl Capped Alcohol Ethylene Oxide/Butylene Oxide Block Alkoxylate The same general procedure is used as in Examples 1 and 2. The starting material is a C9-11 alcohol block alkoxylate, wherein the first block is a polyethylene oxide block (7 units of ethylene oxide) and the second block consists of one unit of 1,2-butylene oxide. This is a capped surfactant, but the structure of the blocks is outside the scope of the surfactants of the invention represented by the structure above.

EXAMPLE 4

(Comparative)—Conventional Low Foaming Nonionic Surfactant

Example 4 is a block alcohol alkoxylate containing a total of 20 units of propylene oxide and 14 units of ethylene oxide. There is no capping of the surfactant. The endgroup consists entirely of hydroxyl group.

Formulations and Testing

The surfactants of Examples 1–4 were formulated into automatic dishwashing tablets. The tablets contained by weight:

- 38.5% sodium tripolyphosphate hexahydrate
- 20% sodium metasilicate pentahydrate
- 36% sodium carbonate
- 2% Pluracol E8000 (polyethylene oxide of molecular weight 8000, sold by BASF Corporation)
- 2% nonionic surfactant of the Examples, and
- 3.3% chlorinated isocyanurate (ACL-59 from Monsanto) to provide 2% available chlorine.

Twenty-five gram tablets having the formulation noted above were pressed under 5000 pounds of pressure using a Carver Laboratory Press and a specially made die of a shape similar to commercially available automatic dishwashing tablets. Tablets were held in the press for one minute before releasing the pressure.

Initial available chlorine levels were measured. Available chlorine is determined by titration with 0.1 N sodium thiosulfate. In an Erlenmeyer flask, 5 g of the sample to be measured, about 100 ml of distilled water, and 25 ml of a 15% by weight potassium iodide solution are added along with a stirring bar. The pH is adjusted to below 4 with concentrated acetic acid. The contents of the flask are titrated to the iodine endpoint with the sodium thiosulfate titrant. It is preferable to add starch to the Erlenmeyer as an indicator for the iodine. The percent available chlorine is calculated from the titration by means of the formula $$\% \text{ available chlorine} = \frac{(\text{ml of titrant}) \times (\text{Normality of titrant}) \times 3.55}{\text{sample weight in grams}}$$

In general, 12 to 25 tablets were prepared of each formulation tested, placed in storage at 120° F., and then tested periodically for remaining available chlorine. The results are expressed in the following Table 1 in terms of the percentage of the original available chlorine remaining after each of the storage periods.

TABLE 1

Available chlorine remaining as a function of storage time

| Tablet Contg. Surfactant | Original % available | % of Original Available Chlorine Remaining after storage at 120° F. for: | | |
|---|---|---|---|---|
| of: | Cl | 2 wks | 4 wks | 8 wks |
| Ex. 1 | 2.00 | 98 | 91 | 87 |
| Ex. 2 | 1.15 | 95 | 88 | 88 |
| Ex. 3 | 2.00 | 76 | 55 | 29 |
| Ex. 4 | 2.10 | 72 | 51 | 34 |

Tablets containing surfactants of Examples 1 and 2 form part of the present invention. It is clearly seen in Table 1 above that tablets formulated with surfactants of the invention exhibit much greater chlorine stability than tablets made from other surfactants outside the scope of the invention. Specifically, tablets made with surfactants of the current invention retain greater than 80% of available chlorine, even after 8 weeks storage at 120° F.

The tablets made from surfactants of Examples 1–4 were also periodically tested for defoaming properties during storage at 120° F. Spray arm efficiency of an automatic dishwasher was determined with a protein soil defoaming test. The background of the use of these tests can be found in I. R. Schmolka et al, "Protein Soil Defoaming In Machine Dishwashers," J. Am. Oil Chem. Soc., 45, No. 8, pp. 563–566 (1968), the entire content of which is incorporated expressly hereinto by reference.

The object of the defoaming tests was to study the effects of milk and egg soils upon the foam control performance of a dishwasher detergent. The conditions and equipment used in these tests were as follows:

A Kitchen Aid, Model UMP-4, dishwasher was used and was equipped with an electronic counter with a graph recorder for measuring the rotations of the machine dishwasher's spray arm and a thermocouple for monitoring the wash solution temperature in the sump. The egg soil used in the defoaming tests was 15 g of blended, raw whole egg. The milk soil used in the defoaming tests was 12 g of Carnation powdered milk. The detergent sample size to be tested was 25 g.

Once the operating temperature was reached, the spray arm rotation rate, in revolutions per minute (rpm) was recorded for the main wash cycle in the following manner.

As the dishwasher door is closed, the electronic counter, which indicates the number of revolutions made by the spray arm, is turned on along with a graph recorder which permanently records the revolutions per minute throughout the test. The rpm of the spray arm at the first minute and the second minute are obtained from the graph. The average of the two is used as the spray arm rotation rate. The readings in rpm are inversely proportional to the amount of foam produced. Hence, the higher the reading, the better the milk, or egg, soil foam control of the detergent.

As a control, the rpm of the spray arm is determined using water alone in the dishwasher. Then for each test, the rpm of the spray arm is determined for the cases where detergent plus milk soil is added, and where detergent plus egg soil is added. The results are reported as spray arm efficiency (SAE) relative to water which is obtained by dividing the rpm value for detergent plus soil by the rpm value of the water blank.

Values of SAE were determined periodically on tablets being stored at 120° F. The results are presented in Table 2 below. The higher the original SAE, the better the defoaming action of the tablet. The defoaming stability of the surfactant is indicated by the dependence of SAE on storage time. If the SAE changes not at all or only very little, then the surfactant is relatively stable. A lowering of the SAE over time, however, indicates that the surfactant is degrading under the conditions, with a loss of its defoaming power.

TABLE 2

Defoaming as a function of storage time

| Tablet Contg. Surfactant | Original SAE | | SAE of Table after storage at 120° F. for 8 wks | |
|---|---|---|---|---|
| Of: | egg soil | milk soil | egg soil | milk soil |
| Ex.1 | 85 | 86 | 84 | 85 |
| Ex.2 | 85 | 86 | 84 | nd |
| Ex.3 | nd | nd | nd | nd |
| Ex.4 | 78 | 93 | 66 | 70 |

Notes:
nd = not determined

In tablets of the current invention (Examples 1 and 2), it is seen from the data above in Table 2 that the spray arm efficiency remains practically constant throughout the 8 week storage period at 120° F. This indicates that the nonionic surfactant remains stable in the tablet for that period of time, since its defoaming power is not diminished. On the other hand, the SAE results with the tablet of Example 4 show that a nonionic surfactant outside the scope of the invention shows poorer stability, in that the defoaming efficiency decreases substantially from 78 to 66 with the egg soil, and from 93 to 70 with the milk soil.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A solid automatic dishwasher detergent tablet comprising a chlorine source in an amount sufficient to provide 0.5 to 5 percent available chlorine; and between about 0.5 to about 10 percent by weight of a nonionic surfactant having the structure:

$$R—(AO1)_x(AO2)_y—OR'$$

wherein

R is a $C_6$–$C_{18}$ alkyl group,

AO1 represents propylene oxide or a mixture of propylene oxide and other alkylene oxides, AO2 represents ethylene oxide or a mixture of ethylene oxide and other alkylene oxides, R' is an alkyl or arylalkyl group with 1 to about 10 carbon atoms, x is 2–20, y is 0–20, and the sum of x plus y is 5 or greater, wherein y is non-zero and wherein the chlorine stability of the tablet is such that greater than 80 percent of the chlorine in the table remains active for eight weeks when the tablet is stored at 120° F.

2. A dishwasher detergent tablet according to claim 1, wherein R' is methyl.

3. A dishwasher detergent tablet according to claim 1, wherein AO1 comprises a heteric blend of propylene oxide and ethylene oxide.

4. A dishwasher detergent tablet according to claim 1, wherein $(AO1)_x$ is a propylene oxide block.

5. A dishwasher detergent tablet according to claim 1, wherein y is non-zero and $(AO2)_y$ is an ethylene oxide block.

6. A dishwasher detergent tablet according to claim 1, wherein each of x and less than 10, and x is less than y, $(AO1)_x$ is a propylene oxide block, and $(AO2)_y$ is an ethylene oxide block.

7. A dishwasher detergent tablet according to claim 6, wherein x is less than or equal to about 5.

8. A dishwasher detergent tablet according to claim 3, wherein x is less than or equal to about 10.

9. A dishwasher detergent tablet according to claim 8, wherein the number of propylene oxide units is greater than the number of ethylene oxide units.

10. A dishwasher detergent tablet according to claim 1, wherein the chlorine source comprises chlorinated isocyanurate.

11. A method for increasing chlorine stability of a pressed automatic dishwater detergent tablet having a chlorine source in an amount sufficient to provide 0.5 to 5 percent available chlorine, said method comprising incorporating a nonionic surfactant into the dishwasher detergent tablet in an effective chorine stability enhancing amount of between about 1 to about 10 percent by weight, said nonionic surfactant having the structure:

$$R—(AO1)_x(AO2)_y—OR'$$

wherein

R is a $C_6$–$C_{18}$ alkyl group,

AO1 represents propylene oxide or a mixture of propylene oxide and other alkylene oxides, AO2 represents ethylene oxide or a mixture of ethylene oxide and other alkylene oxides, R' is an alkyl or arylalkyl group with 1 to about 10 carbon atoms, x is 2–20, y is 0–20, and the sum of x plus y is 5 or greater, wherein y is non-zero and wherein the surfactant is present so as to achieve a chlorine stability of the tablet such that greater than 80 percent of the chlorine in the table remains active for eight weeks when the tablet is stored at 120° F.

12. A method according to claim 11, wherein R' is methyl.

13. A method according to claim 11, wherein AO1 comprises a heteric blend of propylene oxide and ethylene oxide.

14. A method according to claim 11, wherein $(AO1)_x$ is a propylene oxide block.

15. A method according to claim 11, wherein and $(AO2)_y$ is an ethylene oxide block.

16. A method according to claim 11, wherein each of x and y is less than 10, and x is less than y, $(AO1)_x$ is a propylene oxide block, and $(AO2)_y$ is an ethylene oxide block.

17. A method according to claim 16, wherein x is less than or equal to about 5.

18. A method according to claim 13, wherein x is less than or equal to about 10.

19. A method according to claim 18, wherein the number of propylene oxide units is greater than the number of ethylene oxide units.

20. A method according to claim 11, wherein the chlorine source comprises chlorinated isocyanurate.

* * * * *